US009730846B2

(12) United States Patent
Kutsch et al.

(10) Patent No.: US 9,730,846 B2
(45) Date of Patent: Aug. 15, 2017

(54) NESTING WHEELED PERSONAL CONVEYANCES

(71) Applicant: Medline Industries, Inc., Northfield, IL (US)

(72) Inventors: John Kutsch, Harvard, IL (US); Corbett Brown, Round Lake Park, IL (US); Zhiliang Wang, Zhongshan (CN)

(73) Assignee: Medline Industries, Inc., Northfield, IL (US)

( * ) Notice: Subject to any disclaimer, the term of this patent is extended or adjusted under 35 U.S.C. 154(b) by 0 days.

(21) Appl. No.: 14/585,948

(22) Filed: Dec. 30, 2014

(65) Prior Publication Data

US 2015/0182394 A1 Jul. 2, 2015

Related U.S. Application Data

(60) Provisional application No. 61/922,237, filed on Dec. 31, 2013.

(51) Int. Cl.

| | |
|---|---|
| ***A61G 5/08*** | (2006.01) |
| ***A61G 5/10*** | (2006.01) |
| *A61G 5/02* | (2006.01) |

(52) U.S. Cl.

CPC ..... *A61G 5/08* (2013.01); *A61G 5/0891* (2016.11); *A61G 5/10* (2013.01); *A61G 5/1089* (2016.11); *A61G 5/02* (2013.01); *A61G 2203/76* (2013.01)

(58) Field of Classification Search

CPC ..... A61G 5/00; A61G 5/08; A61G 2203/76; A61G 2005/125; A61G 2005/0833; A61G 2005/0808; A61G 5/0891

(Continued)

(56) References Cited

U.S. PATENT DOCUMENTS 2,685,325 A * 8/1954 Webster ..... 297/30
3,497,234 A * 2/1970 Schray ..... B62B 3/144 280/33.993

(Continued)

FOREIGN PATENT DOCUMENTS

DE WO 2013041201 A1 * 3/2013 ..... A61G 5/02
GB 2355696 A 5/2011

(Continued)

OTHER PUBLICATIONS

International Search Report and Written Opinion Dated Mar. 19, 2015 from PCT/US2014/072711.

(Continued)

*Primary Examiner* — Brian Swenson
(74) *Attorney, Agent, or Firm* — Fitch, Even, Tabin & Flannery LLP

(57) ABSTRACT

A wheeled personal conveyance has a rear portion and a front portion, the front portion being configured to receive into the wheeled personal conveyance the rear portion of a like wheeled personal conveyance such that the like wheeled personal conveyance is at least partially nested within the wheeled personal conveyance. By one approach, a body frame as comprises the wheeled personal conveyance has a front portion that is laterally wider than a part of the body frame that comprises a part of the aforementioned rear portion of the wheeled personal conveyance. So configured, the wheeled personal conveyance can have a passenger area that is wider towards the front than towards the back. By one approach, arm rests are provided that connect to a seat of the wheeled personal conveyance and that move in conjunction with the seat as the seat pivots.

10 Claims, 13 Drawing Sheets

(58) Field of Classification Search
USPC ..... 280/33.991, 33.993, 33.996
See application file for complete search history.

(56) References Cited

U.S. PATENT DOCUMENTS

| | | | | |
|---|---|---|---|---|
| 4,639,012 | A * | 1/1987 | Jensen | A61G 5/08 280/47.4 |
| 4,893,827 | A * | 1/1990 | Gay | A61G 5/00 280/250.1 |
| 5,558,358 | A | 9/1996 | Johnson | |
| 5,560,627 | A | 10/1996 | Zatulovsky | |
| D427,949 | S | 7/2000 | Schlangen | |
| 6,142,566 | A | 11/2000 | Ritch | |
| 6,161,848 | A * | 12/2000 | Beumer et al. | 280/33.991 |
| 6,315,306 | B1 * | 11/2001 | Fernie et al. | 280/33.991 |
| 6,412,795 | B1 | 7/2002 | Beumer | |
| 6,447,064 | B1 * | 9/2002 | Mundy | A61G 5/00 297/313 |
| 7,188,855 | B1 * | 3/2007 | Thomas | 280/304.1 |
| D618,141 | S | 6/2010 | Chan | |
| D622,641 | S | 8/2010 | Chen | |
| D623,992 | S | 9/2010 | Derks | |
| D624,459 | S | 9/2010 | Jacobs | |
| D633,830 | S | 3/2011 | Derks | |
| D635,895 | S | 4/2011 | Jacobs | |
| 8,075,017 | B2 * | 12/2011 | Ignacio | 280/642 |
| D699,160 | S | 2/2014 | Yang | |
| 8,985,618 | B2 * | 3/2015 | Perk | A61G 5/02 280/250.1 |
| 2002/0036422 | A1 * | 3/2002 | Prince et al. | 297/411.35 |
| 2003/0090073 | A1 * | 5/2003 | Whang | 280/33.991 |
| 2004/0036258 | A1 * | 2/2004 | Pleasant | A61G 5/08 280/648 |
| 2007/0018426 | A1 | 1/2007 | Willis | |
| 2009/0033052 | A1 | 2/2009 | Bradshaw | |
| 2012/0292879 | A1 * | 11/2012 | Ferniany et al. | 280/250.1 |
| 2013/0140782 | A1 | 6/2013 | Paul | |
| 2013/0140783 | A1 * | 6/2013 | Paul et al. | 280/47.38 |

FOREIGN PATENT DOCUMENTS

| | | |
|---|---|---|
| JP | 2009017974 | 1/2009 |
| WO | 9912507 | 3/1999 |

OTHER PUBLICATIONS

Extended European Search Report from European Patent Application No. 14876459.0 dated Jun. 27, 2017; 8 pages.

* cited by examiner

NESTING WHEELED PERSONAL CONVEYANCES

RELATED APPLICATION(S)

This application claims the benefit of U.S. Provisional application No. 61/922,237, filed Dec. 31, 2013, which is incorporated by reference in its entirety herein.

TECHNICAL FIELD

This invention relates generally to wheeled personal conveyances (such as wheelchairs and rollators).

BACKGROUND

Wheeled personal conveyances such as wheelchairs are typically designed to transport a sitting person. So-called companion chairs are a lighter-duty mechanism having a similar operating purpose. Accordingly, both wheelchairs and companion chairs typically have leg riggings to support the transportee's lower appendages above the ground. Rollators are often viewed as a walking aid and hence often, though not always, lack such leg riggings. Nevertheless, like wheelchairs and companion chairs, many rollators include a seat. For convenience, as used herein the expressions "wheeled personal conveyance" and "rollator" will be understood to include all such conveyance mechanisms.

Many wheeled personal conveyances are designed presuming ownership and usage by a single user. Such wheeled personal conveyances are therefore sometimes designed to fold up to thereby facilitate storage (for example, in a vehicular trunk) and transport to a different place of use. Other wheeled personal conveyances are designed presuming shared stitutional use by a larger population of users. For example, medical services facilities (such as hospitals, medical clinics, outpatient facilities, and doctor's offices), rehabilitative and extended-care facilities (such as nursing homes and assisted-care facilities), and transportation hubs (such as airports) often have a number of wheeled personal conveyances available on site to transport visitors on an as-needed basis.

Use of institutionally-deployed wheeled personal conveyances can be sporadic. As a result, some or even most of the wheeled personal conveyances at a given institutional facility may be presently unused at any given time. In many cases, many of these unused wheeled personal conveyances are stored together at a staging area (such as in a foyer near an entrance to the facility) or in a storage area (such as a storage closet or room). To save space, it is known to nest one rollator within another in the same manner that grocery carts are typically nested one within the other; i.e., by nesting the rearward rollator within the forward rollator through the back of the forward rollator. Though suitable for at least some purposes such an approach does not necessarily meet all needs of all application settings and/or all users.

BRIEF DESCRIPTION OF THE DRAWINGS

The above needs are at least partially met through provision of the nesting wheeled personal conveyance described in the following detailed description, particularly when studied in conjunction with the drawings, wherein.

Figure 1:
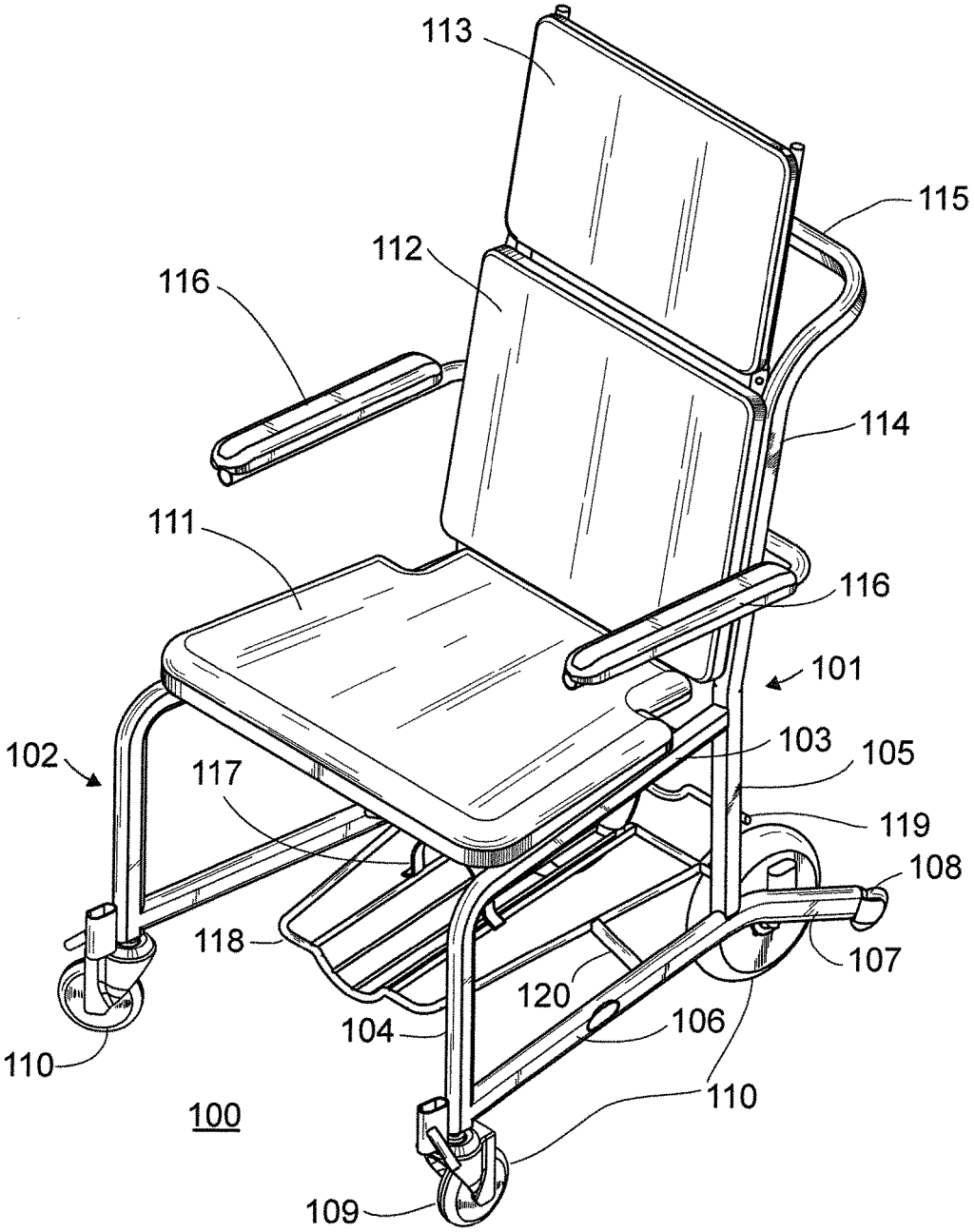
FIG. 1 comprises a perspective view as configured in accordance with various embodiments of the invention.
Figure 2:
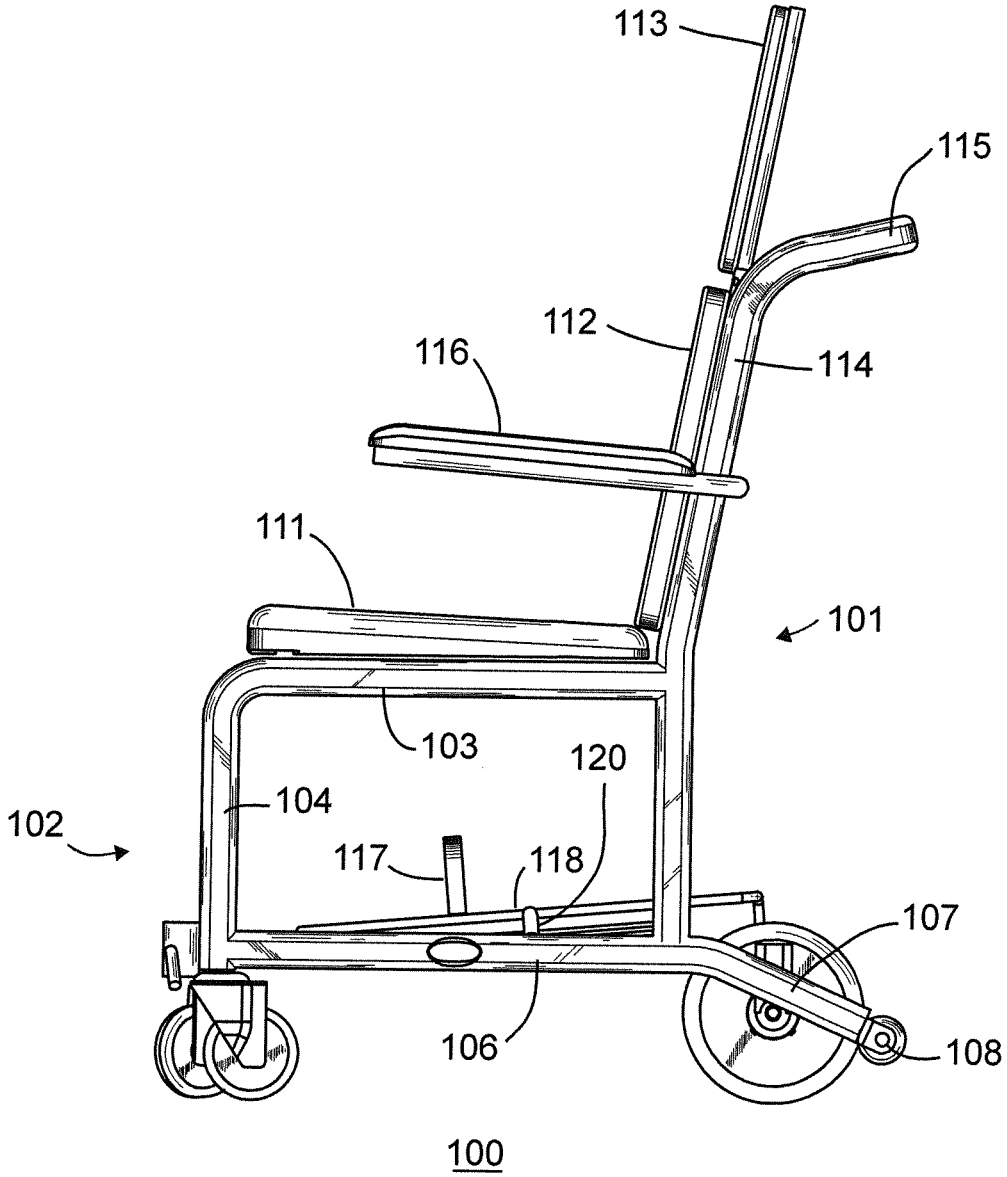
FIG. 2 comprises a side-elevational view as configured in accordance with various embodiments of the invention.
Figure 3:
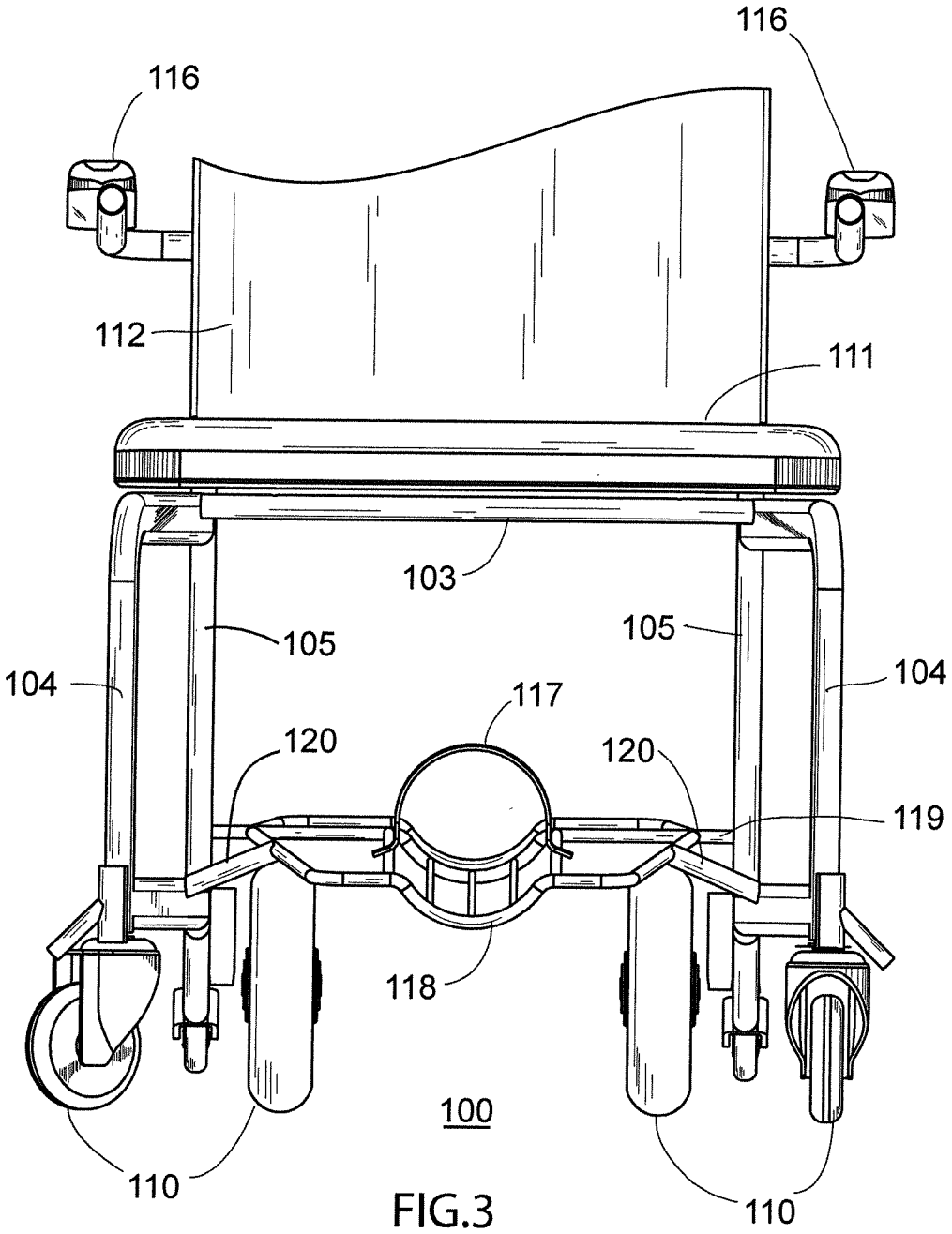
FIG. 3 comprises a front-elevational view as configured in accordance with various embodiments of the invention.
Figure 4:
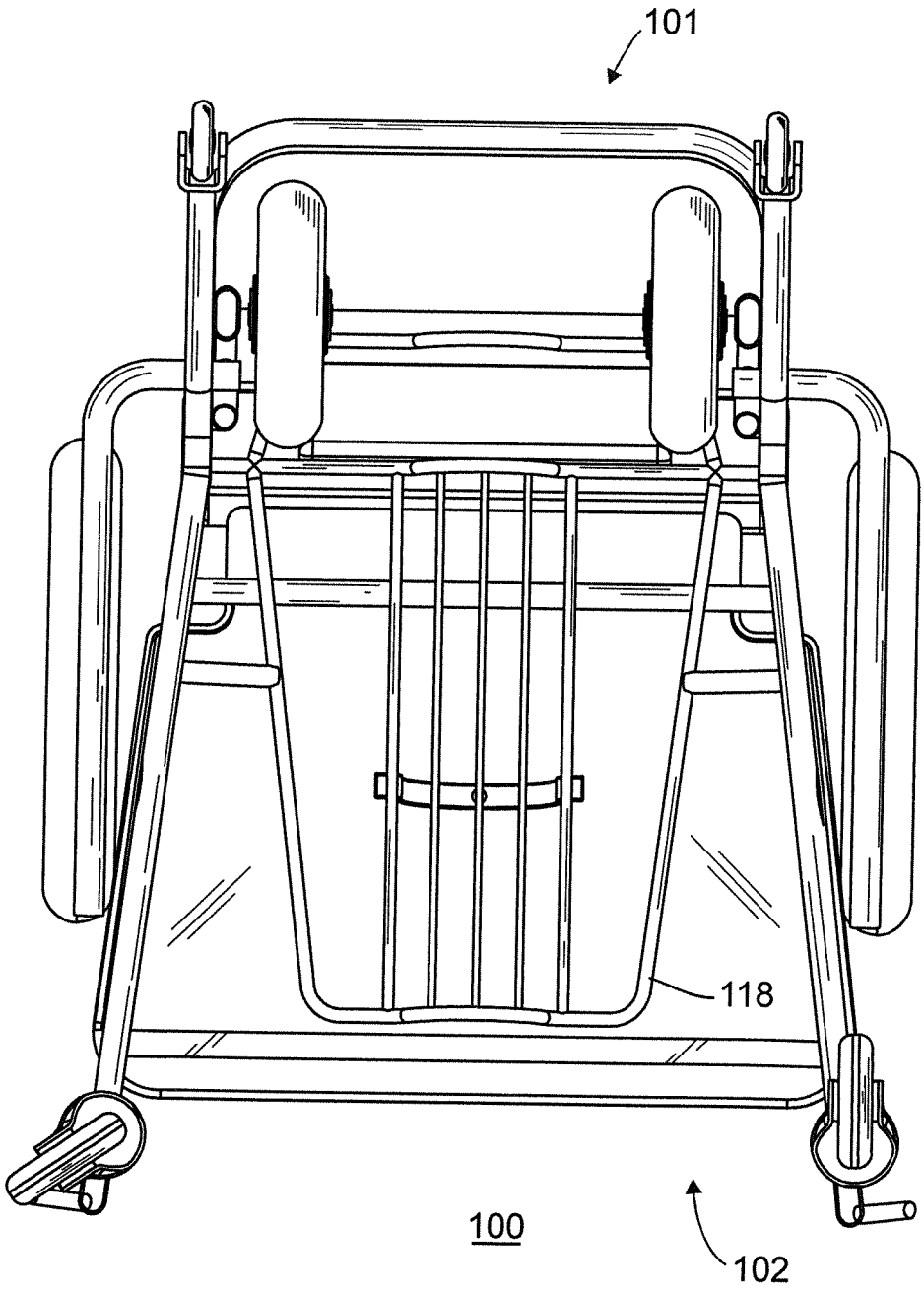
FIG. 4 comprises a bottom plan view as configured in accordance with various embodiments of the invention.

Elements in the figures are illustrated for simplicity and clarity. That said, these illustrations are drawn to scale. Common but well-understood elements that are useful or necessary in a commercially feasible embodiment, however, may not be depicted in order to facilitate a less obstructed view of these various embodiments. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various embodiments, a wheeled personal conveyance has a rear portion and a front portion, the front portion being configured to receive into the wheeled personal conveyance the rear portion of a like wheeled personal conveyance such that the like wheeled personal conveyance is at least partially nested within the wheeled personal conveyance. By one approach this wheeled personal conveyance includes four conveyance-supporting, ground-contacting wheels and comprises a rollator.

By one approach, a body frame as comprises the wheeled personal conveyance has a front portion that is laterally wider than a part of the body frame that comprises a part of the aforementioned rear portion of the wheeled personal conveyance. So configured, the wheeled personal conveyance can have a passenger area that is wider towards the front than towards the back.

Such a configuration can often better accommodate many passengers. In particular, having a wider front can ease seating and unseating passengers having any number of body shapes and sizes. This wider front can also provide the passenger with additional room to adjust their legs, and in particular the relative distance between their knees, while seated. Such a capability can, in turn, greatly facilitate comfort and safety for the passenger both in the short term and in the longer term.

By one approach the seat of the wheeled personal conveyance pivots with respect to the body frame between a deployed, horizontal position and a non-deployed, non-horizontal position. So configured, pivoting the seat into a non-deployed position can help facilitate the aforementioned nesting of one wheeled personal conveyance into another.

If desired, the wheeled personal conveyance can also include arm rests. By one approach these arm rests also pivotally connect with respect to the body. So configured, the arm rests are also pivotal between deployed and non-deployed positions. Pivoting the arm rests to the non-deployed position can also help to facilitate nesting one wheeled personal conveyance into another. By another approach the arm rests are attached to the pivoting seat and hence pivot in conjunction with the seat. If desired the arm rests can be configured to selectively vary their height with respect to the seat.

These teachings are highly flexible in practice and will accommodate a wide variety of variations. For example, by one approach the wheeled personal conveyance can further comprise an oxygen bottle rack that operably couples to the body frame beneath the seat. To facilitate the aforementioned nesting capability the oxygen bottle rack can be pitched downwardly (back to front). By another approach the wheeled personal conveyance can include an IV pole.

So configured, the wheeled personal conveyance can be readily nested with one or more other wheeled personal conveyances to thereby reduce storage space requirements. By receiving the rear portion of another wheeled personal conveyance into the front portion of the wheeled personal conveyance, however, this nesting capability comes without the cost of impinging upon available lateral space in the forward portion of the wheeled personal conveyance. Instead, the wider resultant width at the front of the wheeled personal conveyance can make it easier for the passenger to properly, comfortably, and safely become seated in the wheeled personal conveyance. That wider width can also provide the seated passenger with space and opportunity to adjust the lateral position of their legs to thereby achieve greater comfort while seated. These teachings are also economically practiced and highly intuitive to employ with essentially little or no training.

These and other benefits may become clearer upon making a thorough review and study of the following detailed description. Referring now to the drawings, and in particular to FIGS. 1 through 4, an illustrative example of a wheeled personal conveyance that is compatible with many of these teachings will now be presented. It will be understood that the specifics of this example are intended to serve an illustrative example and are not intended to suggest any specific or particular limitations as to the scope of these teachings. For example, FIGS. 2 and 3 include a number of specific dimensions. These dimensions should not be taken as representing an exhaustive presentation in these regards. In particular, these teachings will readily accommodate other dimensions as desired.

In this illustrative example the wheeled personal conveyance 100 has a rear portion 101 and a front portion 102. Generally speaking, the front portion 102 is configured to receive into the wheeled personal conveyance 100 the rear portion 101 of a like wheeled personal conveyance (not shown in these figures but presented further herein). So configured, the like wheeled personal conveyance is at least partially nested within the wheeled personal conveyance 100.

The wheeled personal conveyance 100 includes a body frame 103 to support and interconnect various components. This body frame 103 can be comprised in whole or in part of any of a variety of appropriate materials including a variety of metals (including aluminum and aluminum alloys), plastics, carbon fiber reinforced materials, and so forth. For many application settings it will serve well for at least portions of the body frame 103 to comprise hollow tubes having circular, oval, or rectangular cross sections (or other cross sectional shapes of choice). In this illustrative example a part of the body frame 103 that comprises a part of the front portion 102 of the wheeled personal conveyance 100 is laterally wider than a part of the body frame 103 that comprises a part of the rear portion 101 of the wheeled personal conveyance 100.

In this example the body frame 103 includes a pair of legs on either side thereof. Referring to the right side of the body frame 103 (as viewed in FIG. 1), each pair of legs includes a front leg 104 and a rear leg 105. As shown most clearly in FIG. 3 the rear legs 105 are disposed more inwardly as compared to the front legs 104 which are disposed more outwardly of the body frame 103. This relative spacing contributes to the ease by which one wheeled personal conveyance can be nested within another as referenced above. By one approach this offset comprises a rake back of 5 degrees for the rear legs. Such a configuration can also help to prevent tipping.

Figure 5:
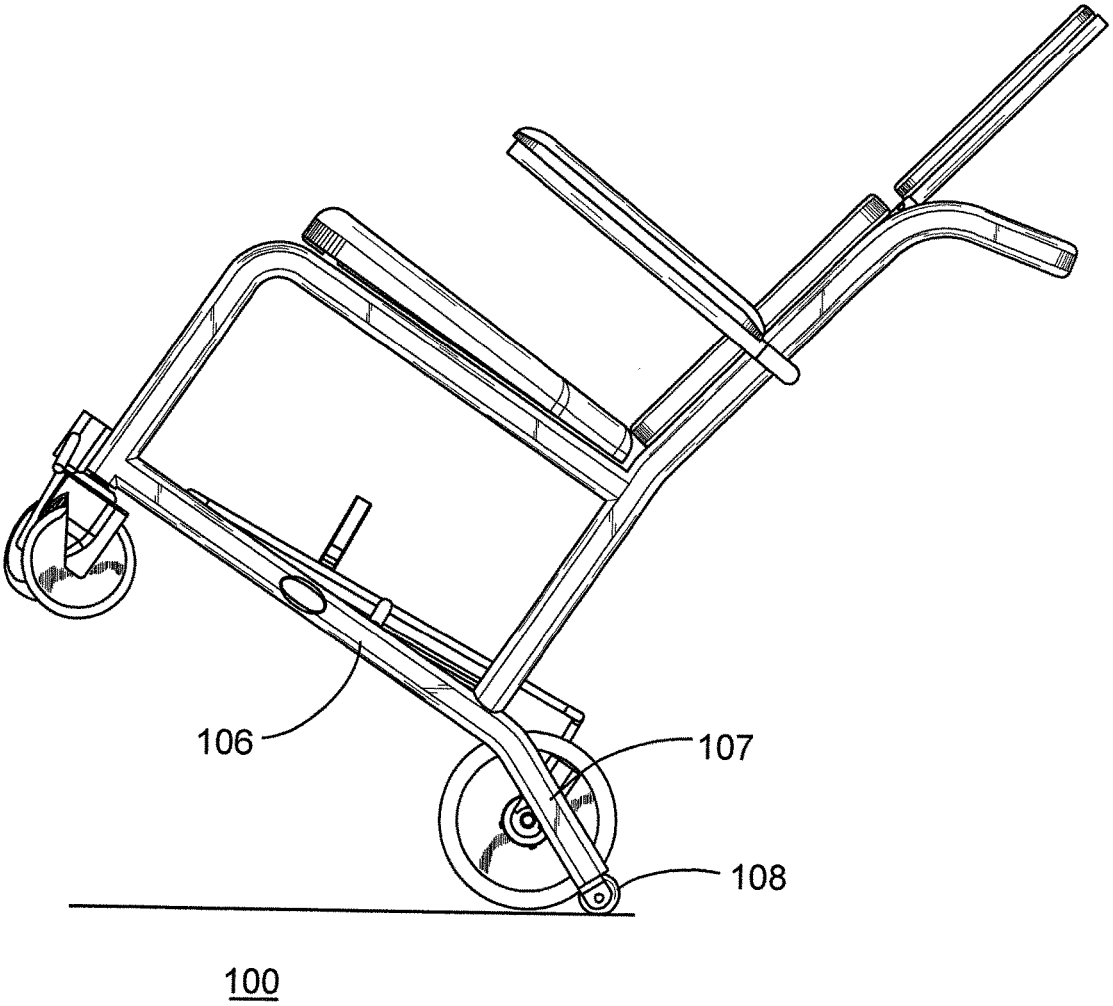
FIG. 5 comprises a side-elevational view as configured in accordance with various embodiments of the invention.

The front leg 104 and rear leg 105 on each side of the body frame 103 are connected to one another at their lower ends by a support member 106. The rear portion 107 of this support member 106 extends outwardly and rearwardly of the aforementioned body frame 103 in this illustrative example and, more particularly, angles downwardly as well. A small wheel 108 is attached at the far end of this rear portion 107. As perhaps best shown in FIG. 5, this arrangement permits the wheeled personal conveyance 100 to be tilted rearwardly to only a certain extent as limited by the angle and extent of that rear portion 107. That small wheel 108, in turn, can help to facilitate further movement of the wheeled personal conveyance 100 on a supporting surface such as a floor when angled back to this maximum extent. A maximum tip angle of 25 degrees, for example, will allow the front wheels to clear an eight inch curb.

Referring again to FIGS. 1-4, a plurality of conveyance-supporting, ground-contacting wheels 110 are disposed on the body frame 103. In this illustrative example the front two wheels 110 are caster-style wheels that can both rotate around a wheel axis and around a pivot axis. So configured, these front wheels 110 will automatically align themselves to the direction of travel. This freedom of movement is represented in the figures by the illustrative convention denoted in FIG. 1 by reference numeral 109.

The rear two wheels 110 in turn rotate around a fixed-position horizontal axis. In this illustrative example the rear wheels are considerably larger in diameter than the front two wheels. These rear wheels can, however, be smaller than the front wheels, the same size as the front wheels, or larger than the front wheels as desired. It would also be possible to configure these rear wheels using a caster arrangement if desired. In this particular example the rear wheels are located in-board of the support member 106 but other configurations are possible. The rear wheels could be located out-board of the support member 106, for example, or could even be located within a corresponding cavity in and through the support member 106 if desired (akin, for example, to a wheel disposed between a fork).

Figure 6:
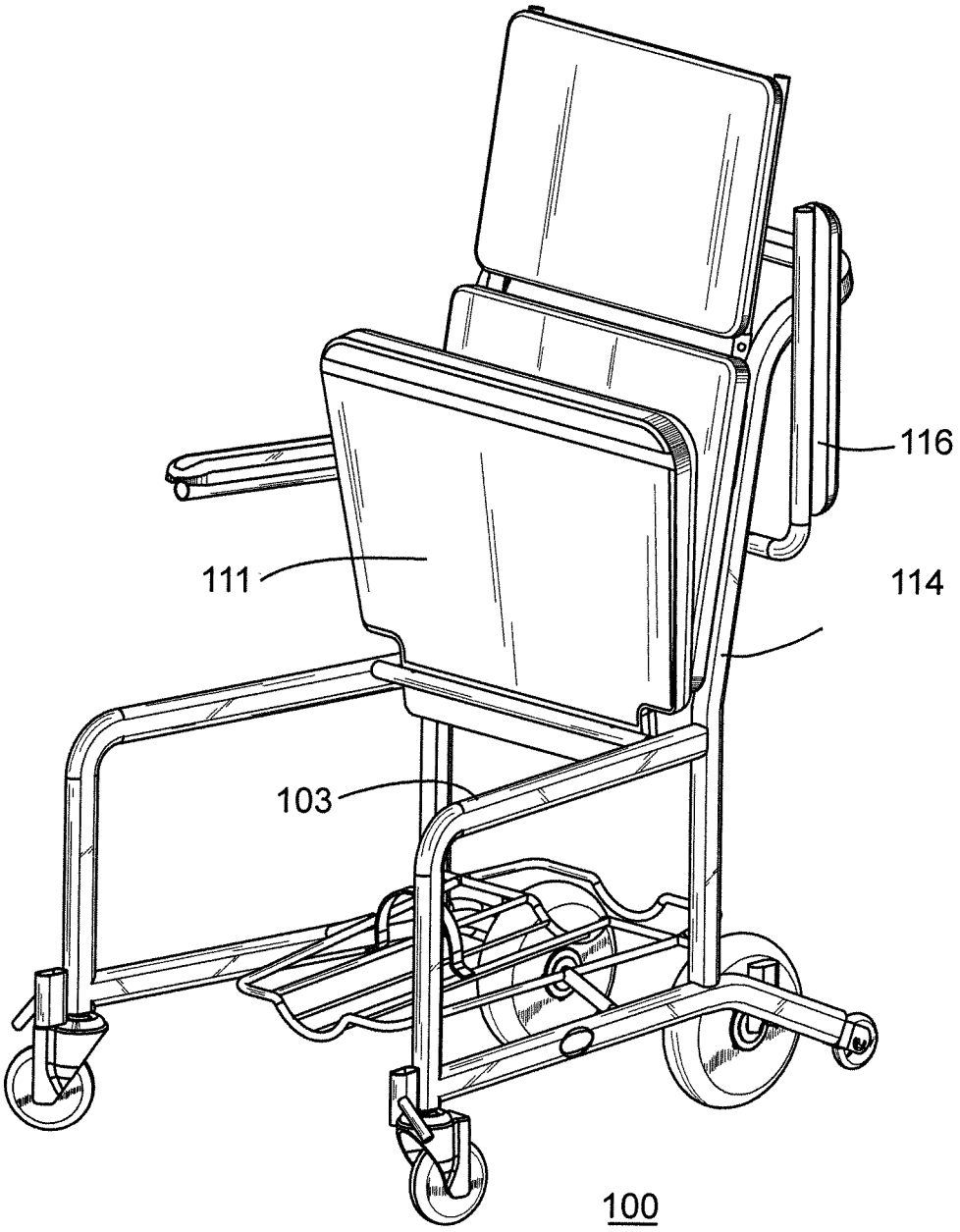
FIG. 6 comprises a perspective view as configured in accordance with various embodiments of the invention.

The wheeled personal conveyance 100 also includes a seat 111 that operably couples to the body frame 103. Seats are well known in the art and it will be understood that this seat 111 can be as contoured or as featureless as desired and can be comprised of any of a wide variety of materials. As the present teachings are not particularly sensitive to any particular choices in these regards, for the sake of brevity further elaboration regarding seat details is not provided here save to note that the seat 111 can be pivotally connected with respect to the body frame 103 (for example, to thereby allow the seat 111 to be selectively pivoted up and back to a non-deployed position that is substantially vertical as illustrated in FIG. 6) and that the width of the seat 111 is wider in this embodiment towards the front portion 102 of the wheeled personal conveyance 100 than towards the rear portion 101 of the wheeled personal conveyance 100 (as is perhaps best seen in FIG. 4).

In this example there is no support beam or other member disposed between the opposing sides of the body frame 103 proximal the front edge of the seat 111. Accordingly, when the seat 111 is pivoted upwardly and back from a horizontal, deployed position towards a non-horizontal, non-deployed position as shown in FIG. 6 there are no other laterally-disposed objects between the sides of the body frame 103. Accordingly, there are no barriers to prohibit the above-mentioned nesting of one wheeled personal conveyance into another in these regards.

In this illustrative example the wheeled personal conveyance 100 also includes a seat back 112 that also operably couples to the body frame 103 and a head rest 113 that connects to the seat back 112. By one approach the head rest 113 can be readily separable from the remainder of the apparatus in order to facilitate shipping and/or limited long-term storage resources.

As with the seat 111 the seat back 112 and head rest 113 can be formed using any of a variety of materials and can assume any of a wide variety of form factors. In the illustrated example the seat back 112 has a fixed position with respect to the body frame 103 and cannot be moved relative to the body frame 103 during ordinary use. (These teachings will accommodate permitting the seat back 112 to be removed from the body frame 103 during maintenance or repair.) These teachings will also accommodate, if desired, permitting the head rest 113 to pivot and/or extend with respect to the seat back 112 to thereby provide some opportunity to the user to adjust the relative position of the head rest 113 with respect to the seat back 112 to achieve a particular custom or otherwise-desired configuration.

The wheeled personal conveyance 100 also includes a pair of arms 114 that extend upwardly at the rear of the body frame 103 to thereby provide support for the backside of the seat back 112 and to provide a footing for a pushbar 115 that extends laterally across the backside of the wheeled personal conveyance 100 proximal (in this example) the aforementioned head rest 113. This pushbar 115 provides a convenient interface by which an attendant can grasp and hold the wheeled personal conveyance 100 in a stationary location and/or push or pull the wheeled personal conveyance 100 in a desired direction to thereby move a person who is seated in the wheeled personal conveyance 100.

By one approach, and as illustrated, the wheeled personal conveyance 100 can also include a pair of arm rests 116 that operably couple on opposing sides of the body frame 103. By one approach these arm rests 116 are pivotally coupled to the body frame 103 and hence are able, for example, to pivot upwardly and towards the rear portion 101 of the wheeled personal conveyance 100 as illustrated in FIG. 6. As with the seat 111 and the seat back 112, arm rests are well known in the art and can be comprised of any of a variety of materials and assume any of a variety of form factors.

If desired, the above-described seating area can be further equipped with a seatbelt. Seatbelts of various kinds are well known in the art and require no further description here.

In this illustrative example the wheeled personal conveyance 100 also includes an oxygen bottle rack 118 disposed beneath the seat 111. This oxygen bottle rack 118 comprises a set of spaced rods that are secured at the rear portion 101 of the wheeled personal conveyance 100 by a rod 119 that extends laterally between the two rear legs 105 of the body frame 103. In this example the oxygen bottle rack 118 receives further support from two lateral struts 120 that extend inwardly from the aforementioned support members 106. When the above-described components comprise rigid materials the oxygen bottle rack 118 will comprise a fixed-position component that is stationary relative the body frame 103 and hence does not move relative to the body frame 103. In this example the oxygen bottle rank 118 includes a shaped and contoured area to receive, conformally, an oxygen bottle (not shown). A securement mechanism 117 of choice can serve to secure the oxygen bottle in place.

In this example the oxygen bottle rack 118 is pitched downwardly, from the back to the front of the wheeled personal conveyance 100. See, in particular, FIG. 2 in these regards. This downward slope of the oxygen bottle rack 118 facilitates being able to nest one wheeled personal conveyance within another without the two respective oxygen bottle racks contacting one another and barring such a nested configuration. For many application settings it will serve well if this slope is around, at greater than, five degrees.

Figure 7:
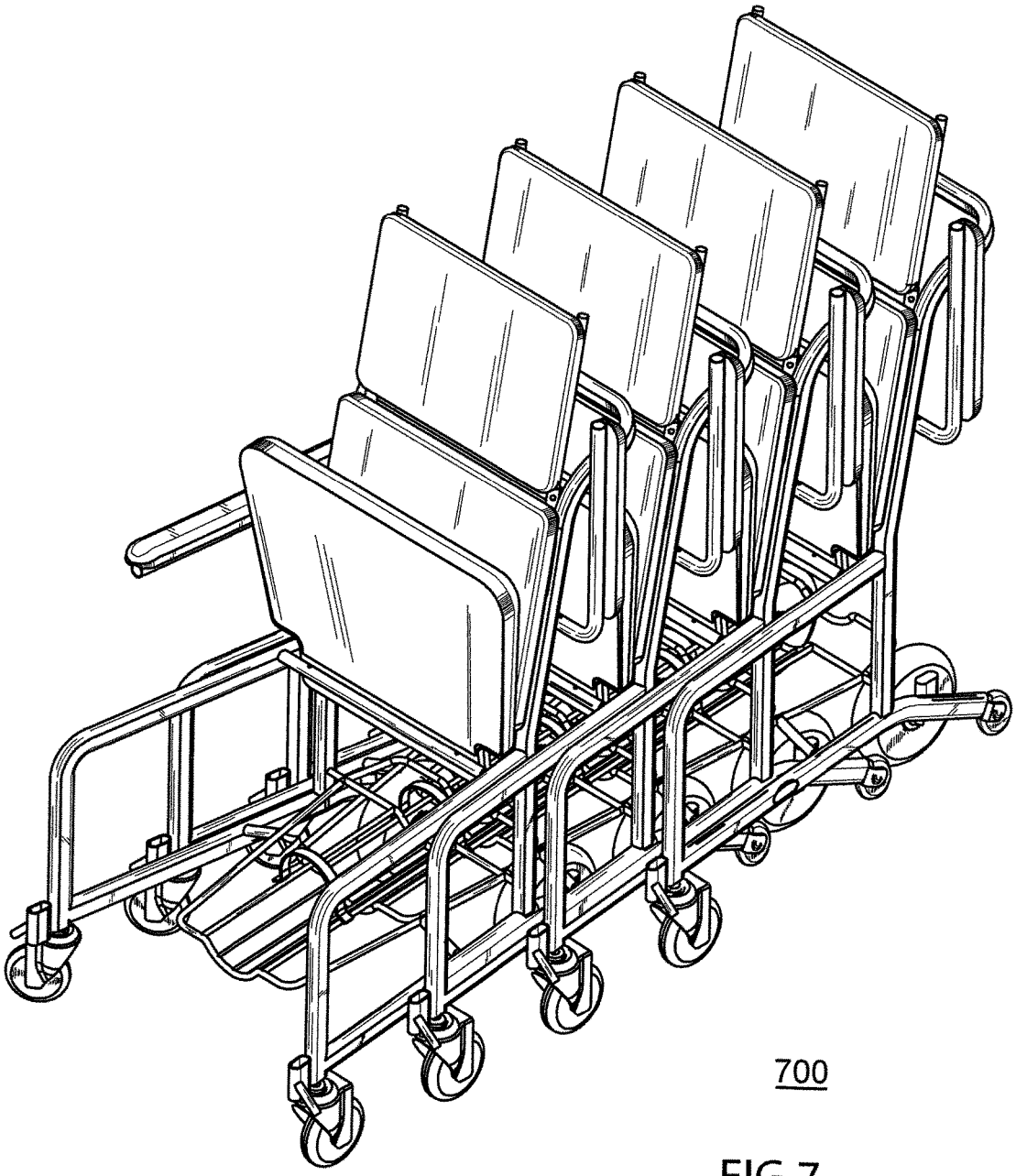
FIG. 7 comprises a perspective view as configured in accordance with various embodiments of the invention.

FIG. 7 provides a view of four wheeled personal conveyances that are sequentially nested as per these teachings. In particular, the front portion of the three rearward wheeled personal conveyance have received the back portion of an adjacent wheeled personal conveyance. This nesting can occur in this example, at least in part, because the opposing sides of the body frame splay outwardly towards that front portion as compared to the back portion of the body frame (notwithstanding that the sides of the body frame are themselves substantially linear). This nesting can also occur, at least in part, because the oxygen bottle rack 118 is angled downwardly from the back part of the wheeled personal conveyance to the front part thereof.

In this example, all of the wheels for both wheeled personal conveyances remain in contact with the ground when the wheeled personal conveyances are nested one within the other. These teachings will accommodate other approaches in these regards if desired, however.

The degree to which such nesting can occur can vary as desired. The illustrated example achieves around a fifty percent nesting ratio. Such nesting, of course, helps to conserve floor space requirements when storing such wheeled personal conveyances for either short term or long term purposes.

The described configuration provides more than merely the ability to support nesting, however. Being configured as described, the front portion of the wheeled personal conveyance is wider relative to the rear portion. As a result, a person sitting in the wheeled personal conveyance has more lateral room for their legs than one might ordinarily expect. This additional room offers greater ease when seating oneself. This additional room also offers greater comfort to a seated person because that person now has more room to move their legs laterally. This added legroom (as compared to prior art approaches) is achieved without necessarily widening the overall apparatus as compared to prior art wheeled personal conveyances.

Those skilled in the art will recognize that a wide variety of modifications, alterations, and combinations can be made with respect to the above described embodiments without departing from the scope of the invention. FIGS. 8 through 13 provide a number of illustrative examples in these regards.

Figure 8:
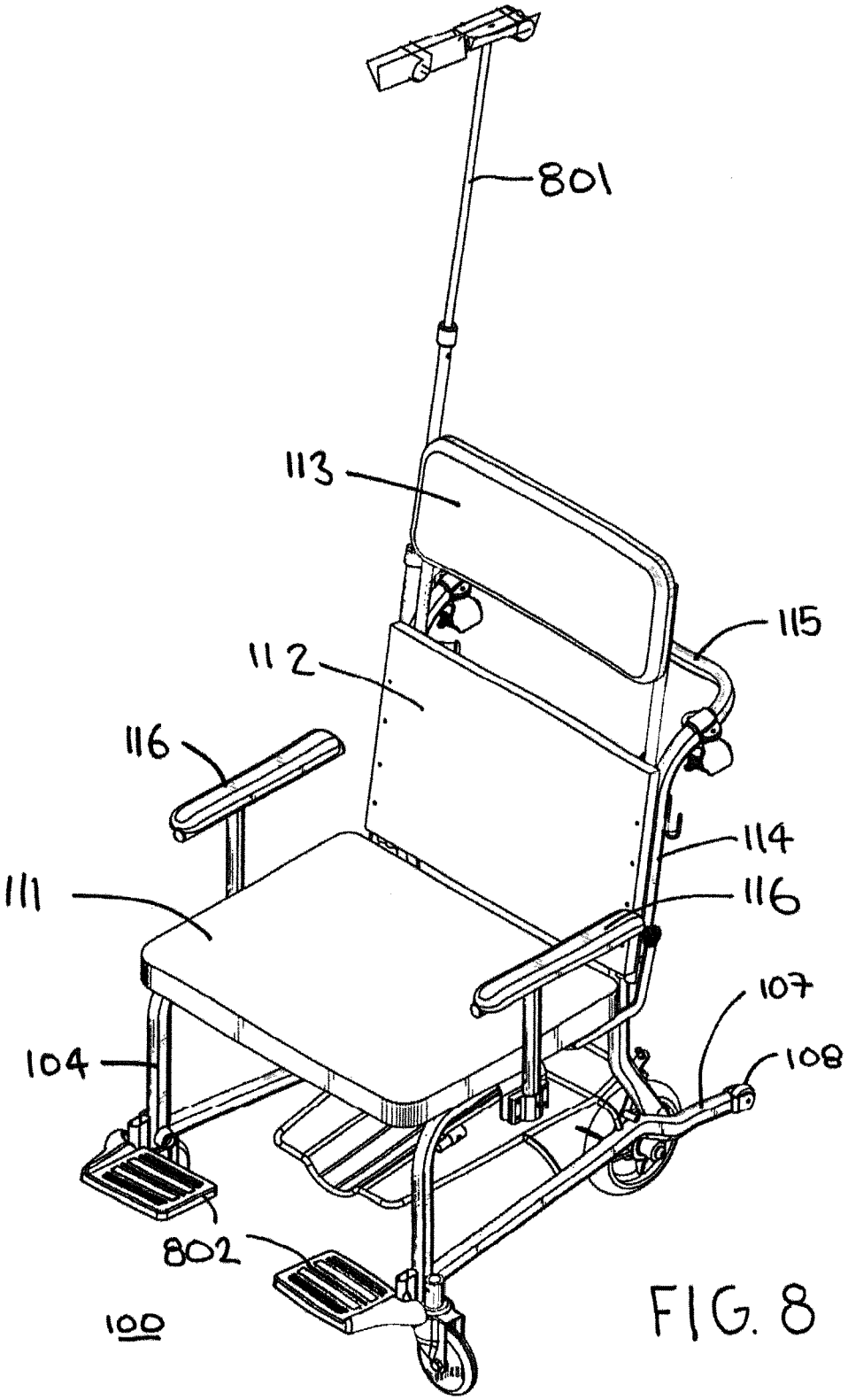
FIG. 8 comprises a perspective view as configured in accordance with various embodiments of the invention.
Figure 9:
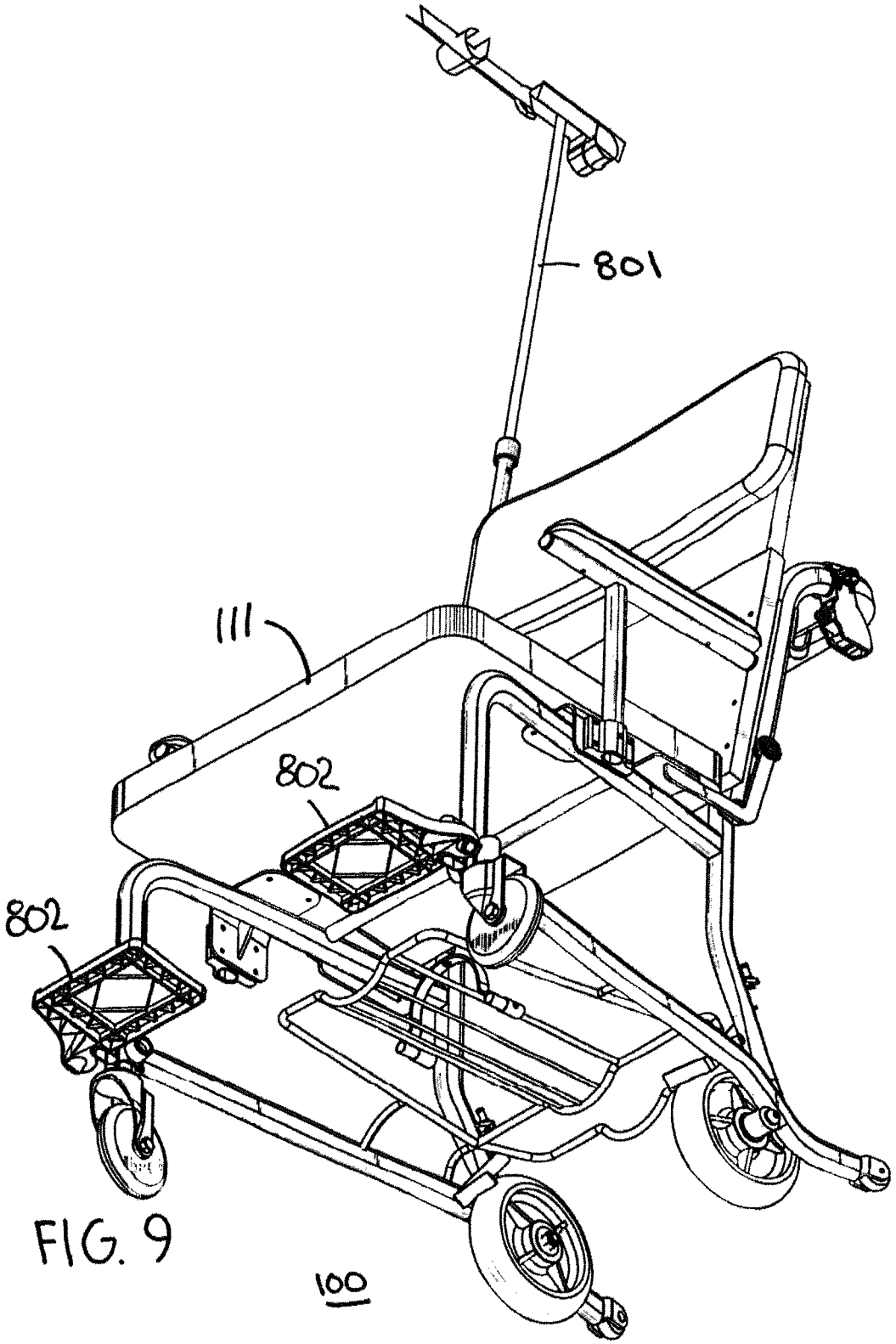
FIG. 9 comprises a bottom perspective view as configured in accordance with various embodiments of the invention.
Figure 10:
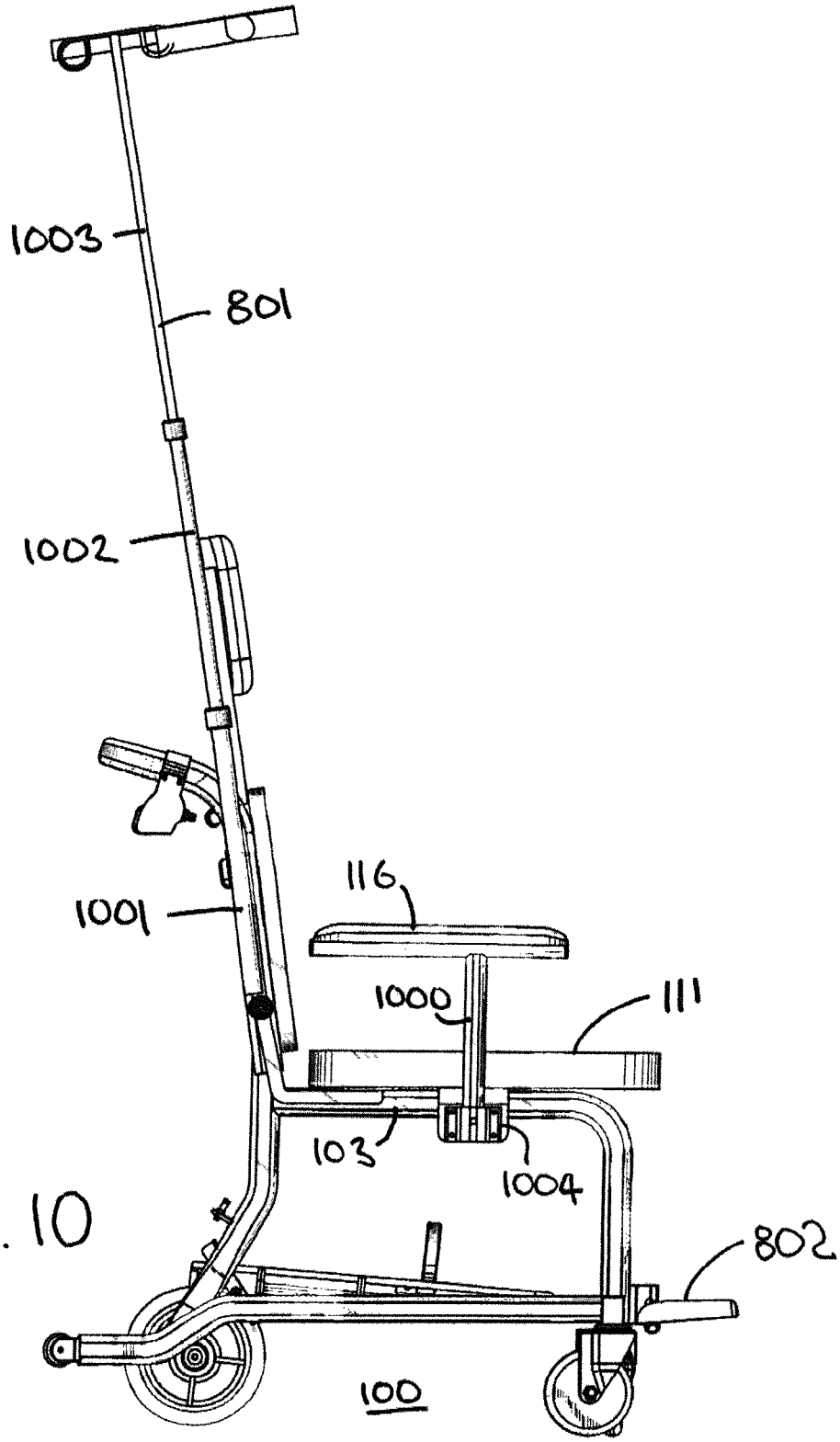
FIG. 10 comprises a side elevational view as configured in accordance with various embodiments of the invention.

Referring in particular to FIGS. 8 through 10, by one approach the wheeled personal conveyance 100 includes an IV pole 801 secured thereto. In this case, and serving as a non-limiting example, the IV pole 801 is attached to one of the arms 114 that extend upwardly at the rear of the body frame 103 to provide support for the backside of the seat back 112. As perhaps best shown in FIG. 10, by one approach the IV pole 801 comprises a telescopic IV pole. In this example the telescopic IV pole includes a first tube 1001 that is sized and configured to receive a smaller-diameter second tube 1002 which in turn is sized and configured to receive a yet-smaller-diameter third tube 1003. These various tubes can be telescopically extended or contracted to thereby deploy them with respect to one another as desired and held in place by any of a variety of known affixment mechanisms.

With continued reference to these particular figures, in this example the wheeled personal conveyance 100 also includes a pair of foot rests 802 that each attach to a respective front leg 104 of the wheeled personal conveyance 100. These foot rests 802 attach to their respective front leg 104 using any of a variety of hinged, pivoted, and or otherwise articulated joints to thereby permit the foot rests 802 to be deployed or otherwise positioned as desired for the convenience of the user and/or to prevent the foot rests 802 from blocking the aforementioned nesting capability of these wheeled personal conveyances 100.

Figure 12:
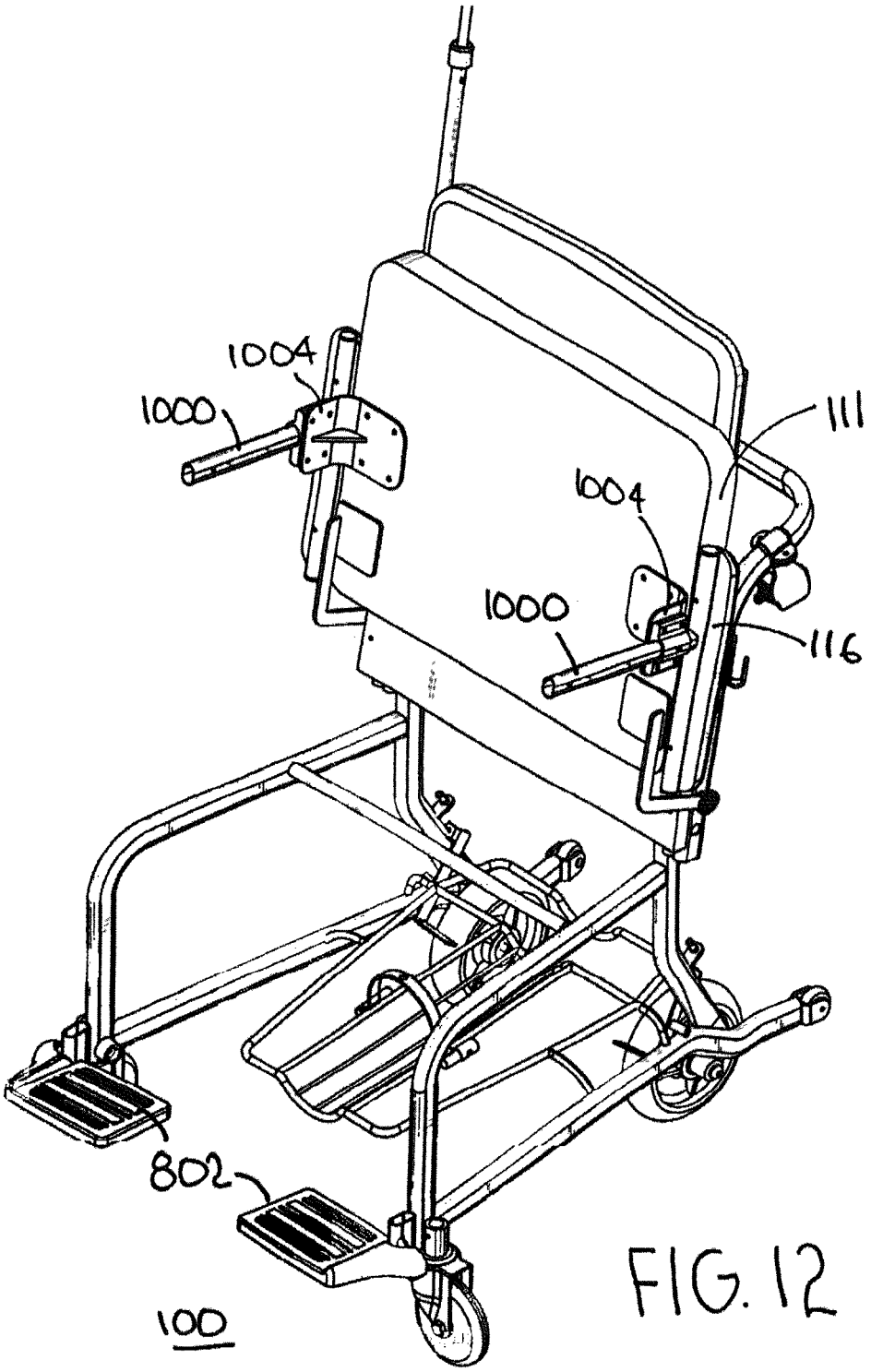
FIG. 12 comprises a perspective view as configured in accordance with various embodiments of the invention.
Figure 13:
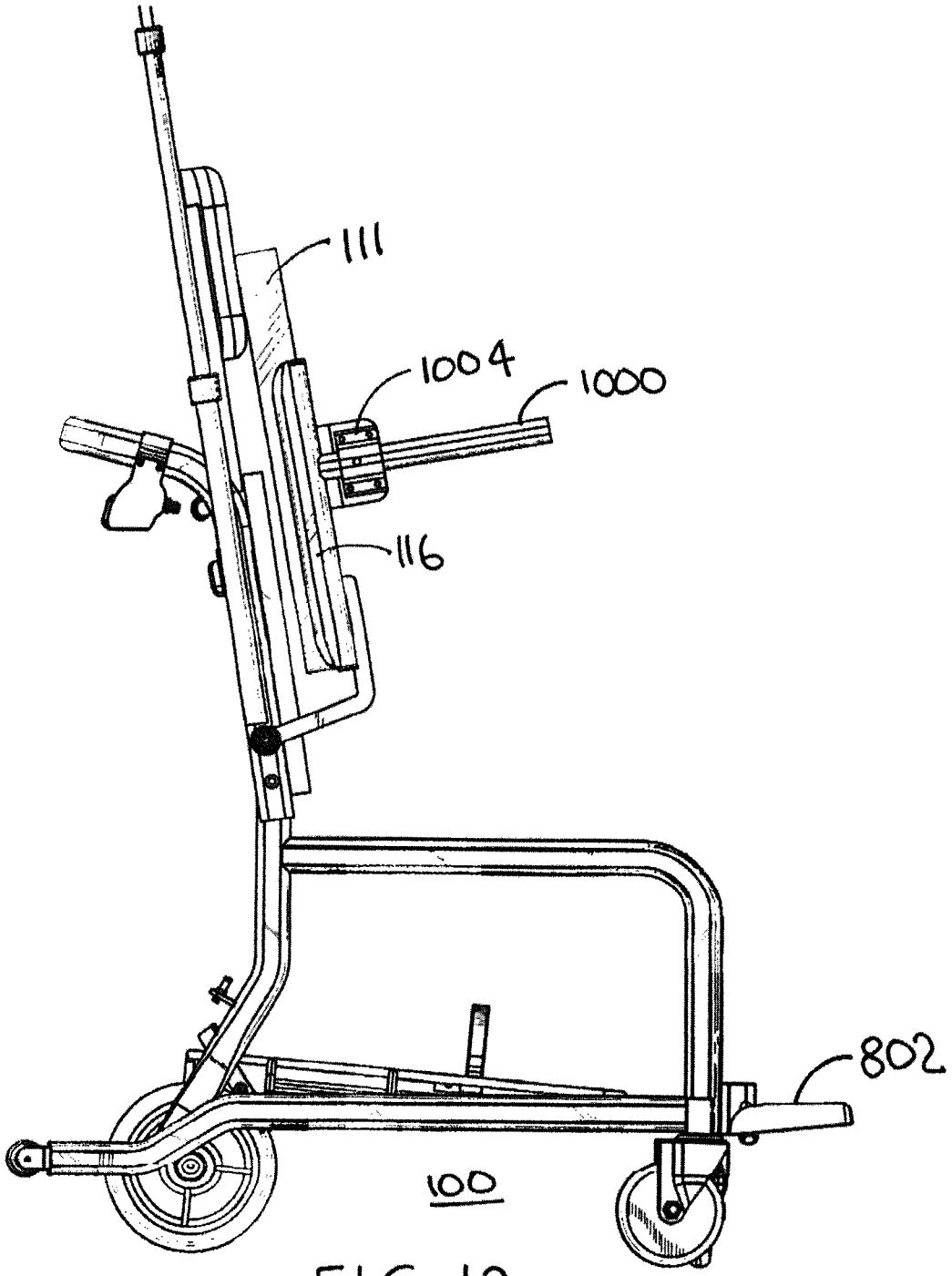
FIG. 13 comprises a side elevational view as configured in accordance with various embodiments of the invention.

While the body frame 103 remains wider at the front than towards the rear in this example, the seat 111 is essentially rectangularly shaped. With the seat 111 pivoted upwardly (as shown in FIGS. 12 and 13) the wider front of the wheeled personal conveyance 100 can again readily receive the rear portion of another wheeled personal conveyance 100. This more rectantularly-shaped seat, however, may be preferred by at least some users.

Figure 11:
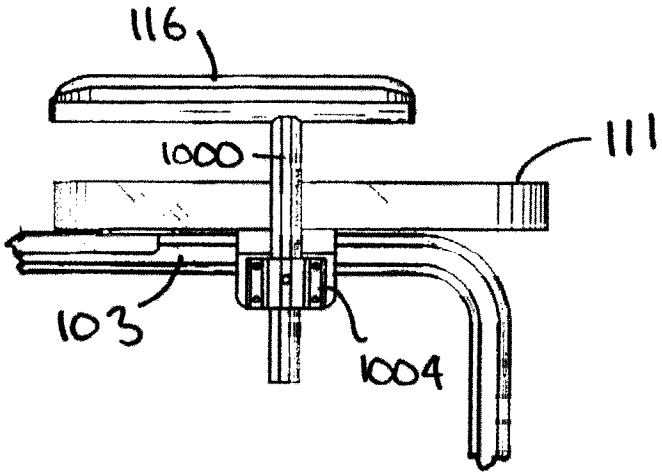
FIG. 11 comprises a side elevational detail view as configured in accordance with various embodiments of the invention.

With continued reference to these figures, but with particular attention to FIGS. 10 and 11, in this example the armrests 116 do not independently pivot with respect to the body frame 103, but instead are attached to the seat 111 and pivoted upwardly as the seat 111 pivots upwardly (as shown in FIGS. 12 and 13). In this illustrative example the armrests 116 each attach to the seat 111 via a post 1000 that slidingly engages a corresponding bracket 1004. These brackets 1004 are secured to the underside of the seat 111 and the posts 1000 are secured to their respective armrests 116 and extend outwardly from the underside thereof at a 90 degree angle. So configured, the height of the armrest 116 with respect to the seat 111 can be selectively adjusted by sliding the post 1000 with respect to the bracket 1004. The post 1000 can be secured if desired to the bracket 1004 at a desired orientation using any of a variety of known attachment mechanisms including but not limited to set screws and detents.

So configured the armrests 116 can be located at a convenient height for the user of the wheeled personal conveyance 100. Also, and as shown in FIGS. 12 and 13, the armrests 116 can be fully (or nearly fully) lowered in order to permit the seat 111 to be fully pivoted into its upright orientation to serve the nesting capabilities of this wheeled personal conveyance 100.

What is claimed is:

1. An apparatus comprising:

a wheeled personal conveyance having:

a rear portion and a front portion, the front portion being configured to receive into the wheeled personal conveyance the rear portion of a like wheeled personal conveyance such that the like wheeled personal conveyance is at least partially nested within the wheeled personal conveyance;

a body frame;

a seat that is pivotally connected with respect to the body frame;

a seat back that is fixed with respect to the body frame and cannot be moved relative to the body frame during ordinary use; and arm rests operably coupled to the seat such that the arm rests move with the seat as the seat pivots with respect to the body frame.

2. The apparatus of claim 1 wherein the wheeled personal conveyance includes four conveyance-supporting, ground-contacting wheels.

3. The apparatus of claim 1 wherein a part of the body frame that comprises a part of the front portion is laterally wider than a part of the body frame that comprises a part of the rear portion.

4. The apparatus of claim 1 wherein the seat pivots rearwardly when pivoting from a deployed position to an undeployed position.

5. The apparatus of claim 1 wherein the arm rests are slidingly connected to the seat.

6. The apparatus of claim 1 wherein the wheeled personal conveyance further comprises an oxygen bottle rack that operably couples to the body frame and that is disposed beneath the seat.

7. The apparatus of claim 6 wherein the oxygen bottle rack is pitched downwardly, back to front.

8. A rollator comprising:

a body frame having opposing sides, wherein the sides splay outwardly towards a front portion of the body frame as compared to a back portion of the body frame;

a plurality of ground-contacting wheels disposed on the body frame;

a seat that operably couples to the body frame and that pivots between a deployed horizon position and a non-deployed, non-horizontal position;

a seat back that is fixed with respect to the body frame and cannot be moved relative to the body frame during ordinary use;

arm rests operably coupled to the seat such that the arm rests move with the seat as the seat pivots with respect to the body frame, each of the arm rests being connected to a corresponding post that slidingly couples to the seat and wherein the post for each of the arm rests connects to the arm rest at a point that is forward of a midpoint of the arm rest;

such that a like rollator is readily nested, at least in substantial part, within the rollator by placing a back part of the like rollator into a front part of the rollator.

9. The rollator of claim 8 wherein the plurality of ground-contacting wheels of both the rollator and the like rollator remain in contact with the ground when the like rollator is nested within the rollator.

10. The rollator of claim 9 wherein the sides of the body frame are at least substantially linear.

* * * * *